US006058857A

United States Patent [19]

Nakai et al.

[11] Patent Number: 6,058,857

[45] Date of Patent: May 9, 2000

[54] FLUIDIZED BED TYPE INCINERATOR

[75] Inventors: Seiichi Nakai; Ryozo Shiji; Takeshi Matsui; Norihiro Aoki; Yoshimasa Miura; Yusuke Okada, all of Osaka, Japan

[73] Assignee: Hitachi Zosen Corporation, Osaka, Japan

[21] Appl. No.: 08/973,851

[22] PCT Filed: Apr. 21, 1997

[86] PCT No.: PCT/JP97/01375

§ 371 Date: Mar. 23, 1998

§ 102(e) Date: Mar. 23, 1998

[87] PCT Pub. No.: WO97/41389

PCT Pub. Date: Nov. 6, 1997

[30] Foreign Application Priority Data

Apr. 26, 1996 [JP] Japan ..... 8-105965

[51] Int. Cl.[7] ..... F23G 5/00; F23G 7/00; B01J 8/18

[52] U.S. Cl. ..... 110/245; 110/297; 110/348; 122/4 D; 422/139; 422/143; 422/145

[58] Field of Search ..... 110/245, 243, 110/251, 297, 348; 432/215, 58; 431/7, 170; 122/4 D; 165/104.16; 34/578, 582; 422/139, 140, 141, 142, 143, 144, 146

[56] References Cited

U.S. PATENT DOCUMENTS

| | | | |
|---|---|---|---|
| 4,359,326 | 11/1982 | Hoffert et al. | 48/62 R |
| 4,823,740 | 4/1989 | Ohshita et al. | 165/104.16 X |
| 4,942,673 | 7/1990 | Dellinger | 34/10 |
| 5,093,085 | 3/1992 | Engstrom et al. | 422/143 |
| 5,156,099 | 10/1992 | Ohshita et al. | 110/245 |
| 5,343,830 | 9/1994 | Alexander et al. | 122/4 D |
| 5,379,705 | 1/1995 | Takada et al. | 110/245 |
| 5,687,657 | 11/1997 | Ziegler | 110/234 |

FOREIGN PATENT DOCUMENTS

| | | | |
|---|---|---|---|
| 56-42008 | 4/1981 | Japan | 110/245 |
| 63-73091 | 4/1988 | Japan | 165/104.16 |
| 826978 | 1/1960 | United Kingdom | 165/104.16 |

*Primary Examiner*—James C. Yeung
*Assistant Examiner*—Ljiljana V. Ciric
*Attorney, Agent, or Firm*—Reising, Ehtington, Barnes, Kisselle, Learman & McCulloch, PC

[57] ABSTRACT

A plurality of dispersive air pipes for combustion (11) containing a plurality of dispersive air holes and projecting in a cantilever fashion from the side walls (1*b*, 1*c*) in an oblique downward direction are provided in the lower portion of a combustion zone (2*b*) of a furnace main unit (1) which includes an ash discharge outlet (6) formed in the base portion of the furnace main unit, and an incombustible material discharge space (12) is formed between the ends of the dispersive air pipes for combustion (11). As a result, incombustible material accumulating on the dispersive air pipes for combustion (11) is guided to the incombustible material discharge space (12) and then discharged.

4 Claims, 9 Drawing Sheets

FLUIDIZED BED TYPE INCINERATOR

TECHNICAL FIELD

The present invention relates to a fluidized bed incinerator wherein municipal solid waste, industrial waste, and the like is introduced into a fluid medium which is in a fluid state, and the waste is heated and incinerated.

BACKGROUND ART

As shown in FIG. 10, a conventional fluidized bed waste incinerator comprises: a combustion chamber 2 and a free-board space 3 formed in a main furnace unit 1; a waste inlet 4 formed in the front wall 1*a* of the main furnace unit 1; an ash discharge outlet 6 formed in the rear base portion of the main furnace unit 1; a discharging device 5 provided at this ash discharge outlet 6, which discharges incinerated ash and incombustible material whilst leaving the fluid medium S; and a plurality of dispersive air pipes 7 arranged mutually in parallel passing through the lower portion of the combustion chamber in a horizontal direction.

In the composition described above, the heated fluid medium S is caused to become fluid by means of dispersive air injected into the fluid medium S in the furnace main unit 1 from dispersive air pipes 7. Waste to be incinerated is introduced via the waste inlet 4 and mixes into the fluid medium S, and the waste is heated, fluidized and then combusts in a combustion zone in the upper portion of the combustion chamber 2. Incinerated ash is carried to the ash discharge outlet 6 by the downward movement of the fluid medium S, and then discharged.

The dispersive air pipes 7 pass through side walls 1*b* of the main furnace unit 1 transversely in a horizontal direction. Adjacent dispersive air pipes 7 are spaced to have a gap of approximately 100–150 mm between each other. There are cases where large items of incombustible material or linear items of incombustible material, such as wire or the like, which are larger than this gap, may be present in the waste introduced into the incinerator, or large lumps of clinker may form during incineration. In these cases, there arises a problem that such items will accumulate above the dispersive air pipes 7, due to the narrow gaps between the dispersive air pipes, and will not be discharged from the ash discharge outlet 6, thereby rendering the incinerator inoperable.

DISCLOSURE OF THE INVENTION

It is an object of the present invention to provide a fluidized bed incinerator whereby large items of incombustible material, linear items of incombustible material, large lumps of clinker and the like can be discharged smoothly.

In order to achieve this object, the fluidized bed incinerator according to the present invention is characterized in that it comprises an ash discharge outlet formed in the base portion of a furnace main unit; a plurality of dispersive air pipes for combustion containing a large number of dispersive air holes formed therein, which project respectively in a cantilever fashion from mutually opposing side walls in an oblique downward direction at the lower portion of a combustion zone of the furnace main unit; and an incombustible material discharge space formed between the ends of these dispersive air pipes for combustion.

Furthermore, the invention is also characterized in that it comprises an ash discharge outlet formed in the base portion of a furnace main unit; a plurality of dispersive air pipes for combustion containing a large number of dispersive air holes formed therein, which project in a cantilever fashion from a side wall in an oblique downward direction at the lower portion of a combustion zone of the furnace main unit; and an incombustible material discharge space formed between the ends of these dispersive air pipes for combustion and a side wall.

According to the composition described above, since solid items of incombustible material and linear items of incombustible material present in waste for incineration and introduced into the fluid medium, or large lumps of clinker formed in the fluid medium, are guided in a downward direction on the inclined dispersive air pipes for combustion and are discharged from the incombustible material discharge space to the ash discharge outlet, then incombustible material of this kind can be discharged smoothly without accumulating on the dispersive air pipes for combustion. Furthermore, this composition is characterized in that the angle of inclination of the dispersive air pipes for combustion is set to be in a range of 3°–30°.

According to the composition described above, by setting the angle of inclination of the dispersive air pipes for combustion in a range of 3°–30°, incombustible material on the dispersion pipes can be guided downwards smoothly and discharged from the incombustible material discharge space to the ash discharge outlet without any accumulation thereof, and furthermore, there is no detrimental effect on dispersion of the fluid medium.

Moreover, the invention is characterized in that the incombustible material discharge space in the composition described above comprises a normal incombustible material discharge space having a narrow width, and a large incombustible material discharge space having a broad width.

If only a large incombustible material discharge space is provided, which is wide and capable of discharging large items of incombustible material, there is a risk that the fluidity of the fluid medium will be impaired. According to the composition described above, however, it is possible for large items of incombustible material to be discharged without impairing the fluidity of the fluid medium, by providing both a large incombustible material discharge space for large items and a narrow incombustible material discharge space for normal items.

In addition, the dispersive air pipes for combustion in the composition described above are characterized in that they are each provided with: a large number of main dispersive air holes formed along the barrel thereof, through which dispersive air is emitted, and an end dispersive air hole formed in the end thereof, through which dispersive air is emitted towards the incombustible material discharge space.

According to the composition described above, by emitting dispersive air towards the incombustible material discharge space from the end dispersive air holes in this way, incombustible material on the dispersive air pipes for combustion is caused to flow towards the incombustible material discharge space, and moreover, this incombustible material is able to drop down without creating resistance, and the flow of the fluid medium is promoted when this material drops.

DESCRIPTION OF THE EMBODIMENTS

Figure 1:
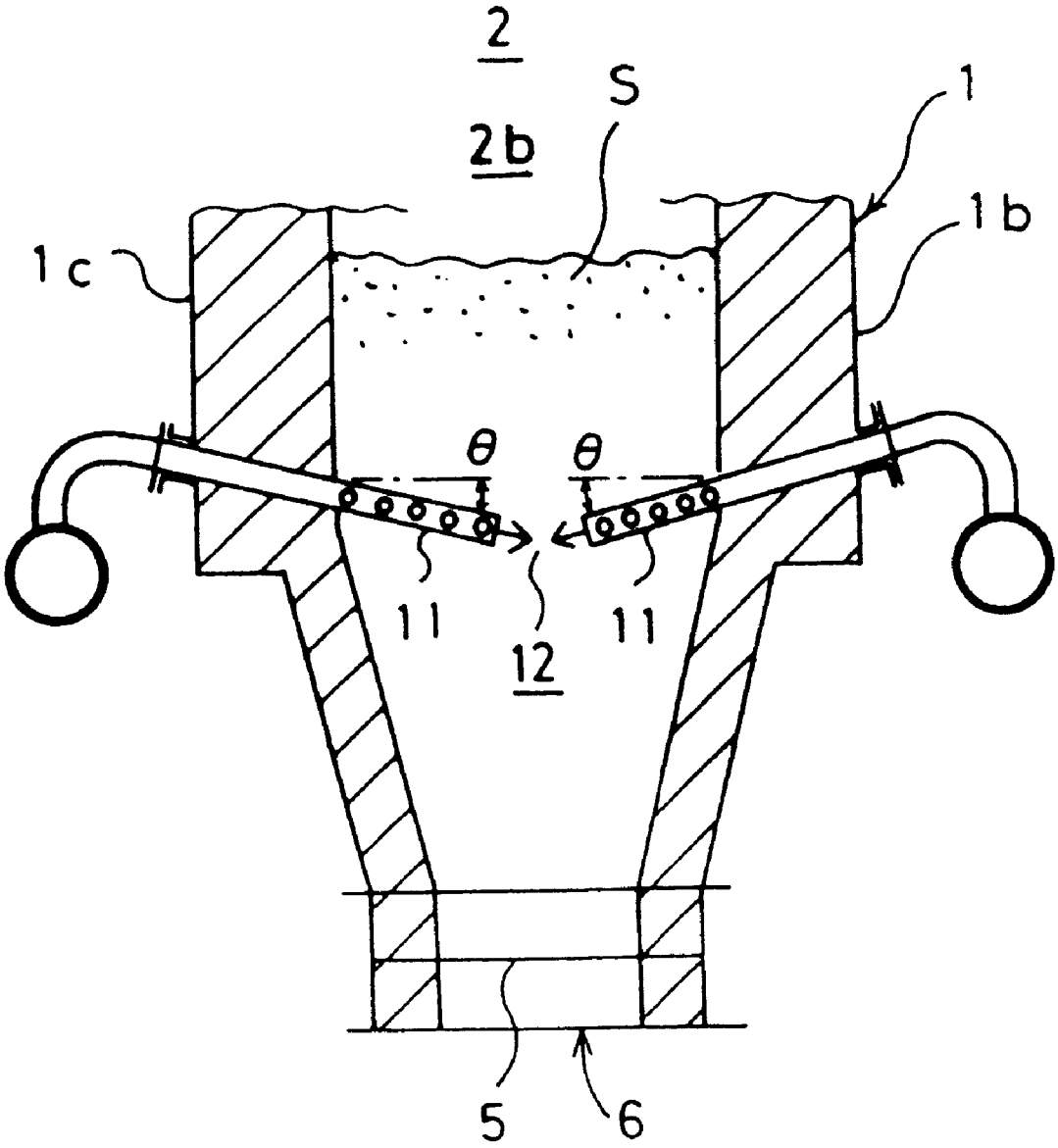
FIG. 1 is a side section showing a first embodiment of a fluidized bed waste incinerator according to the present invention.
Figure 2:
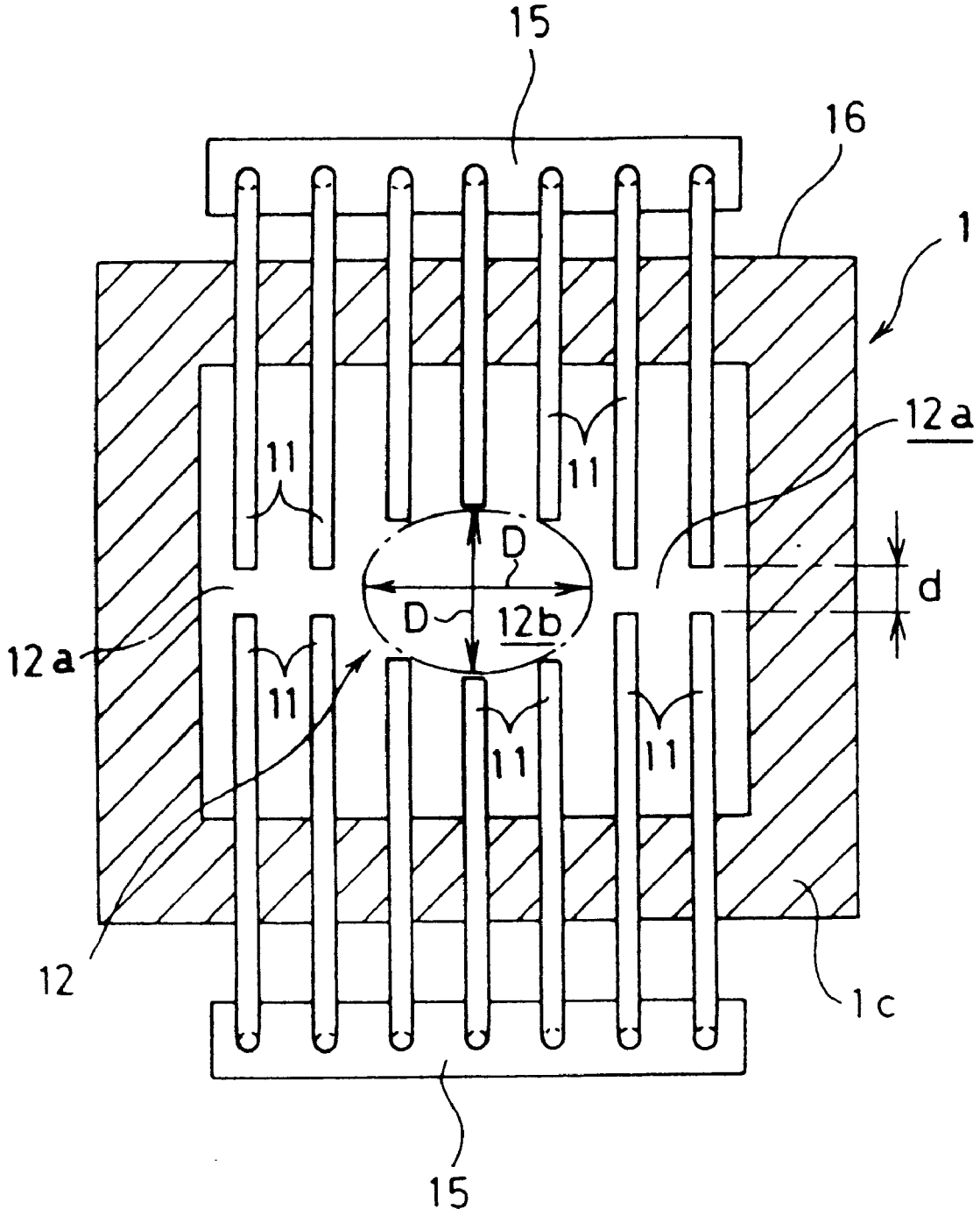
FIG. 2 is a planar section of the same fluidized bed waste incinerator.
Figure 3:
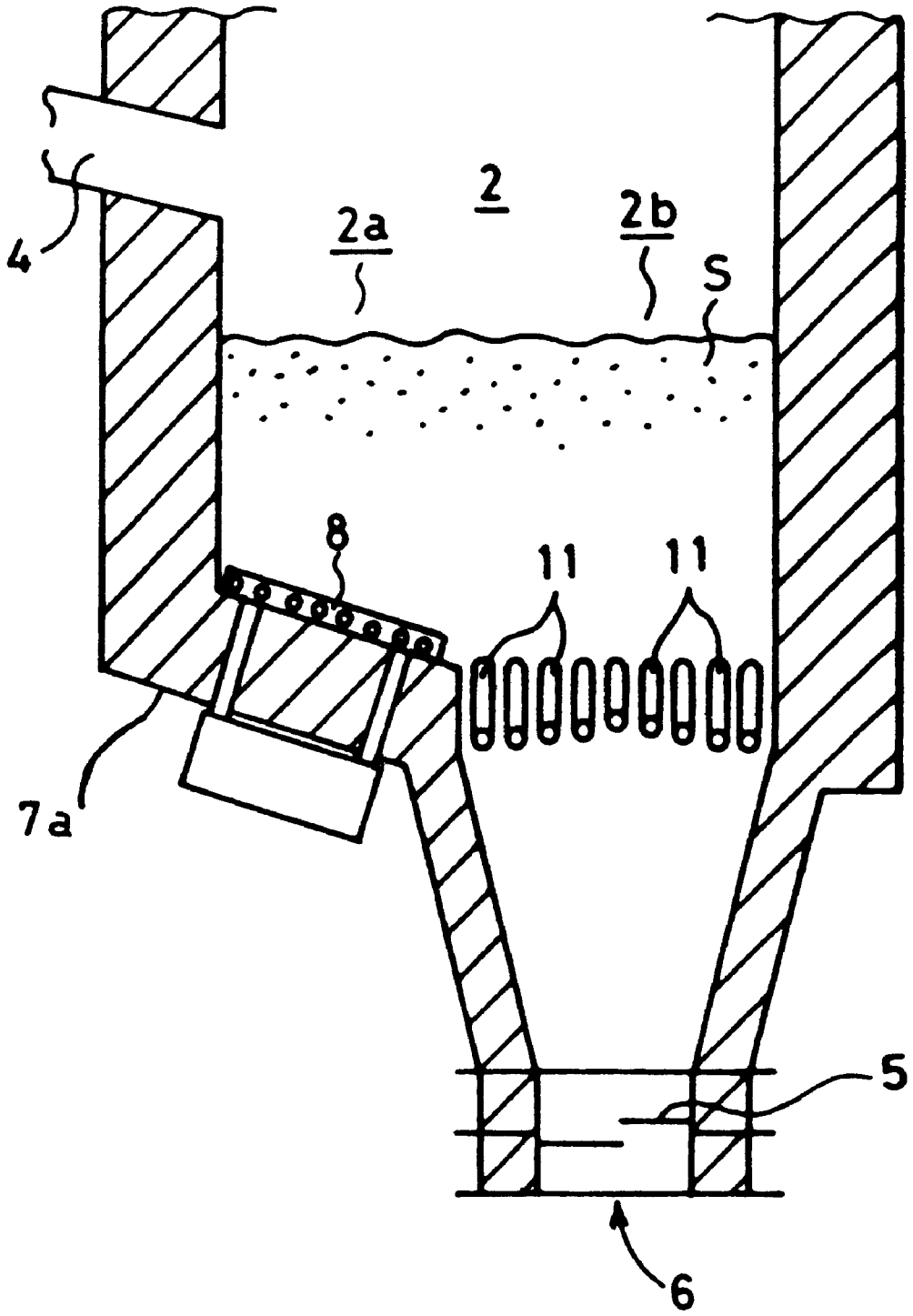
FIG. 3 is a side section of the same fluidized bed waste incinerator.

Embodiments of a fluidized bed waste incinerator relating to the present invention are now described. Elements which are the same as in the prior art example are given the same label and description thereof is omitted.

FIGS. 1–4 show a first embodiment, which is a fluidized bed waste incinerator wherein dispersive air pipes for combustion 11 are provided in both side walls 1*b*, 1*c*.

The combustion chamber 2 of the furnace main unit 1 consists of a drying and pyrolyzing zone 2*a* at the side of the waste inlet 4, and a combustion zone 2*b* located above the ash discharge outlet 6. Dispersive air pipes 8 for pyrolysis which supply dispersive air to the drying and pyrolyzing zone 2*a* are provided on an inclined base wall 7*a* below the drying and pyrolyzing zone 2*a*. Furthermore, a plurality of dispersive air pipes for combustion 11 extend from air lines 15, passing through both side walls 1*b*, 1*c* and projecting respectively into the fluid medium S are provided below the combustion zone 2*b*.

These dispersive air pipes for combustion 11 project from the side walls 1*b*, 1*c* in a cantilever fashion at an angle of inclination θ in a downward direction, and are positioned in parallel to each other spaced so that ash can be discharged therebetween. An incombustible material discharge space 12 is formed between the ends of these dispersive air pipes for combustion 11 so that incombustible material on the dispersive air pipes for combustion 11 can be discharged through the incombustible material discharge space 12 toward the ash discharge outlet. The ash discharged between the parallel dispersive air pipes for combustion 11 is discharged through a space under the dispersive air pipes for combustion 11 toward the ash discharge outlet 6.

Figure 4:
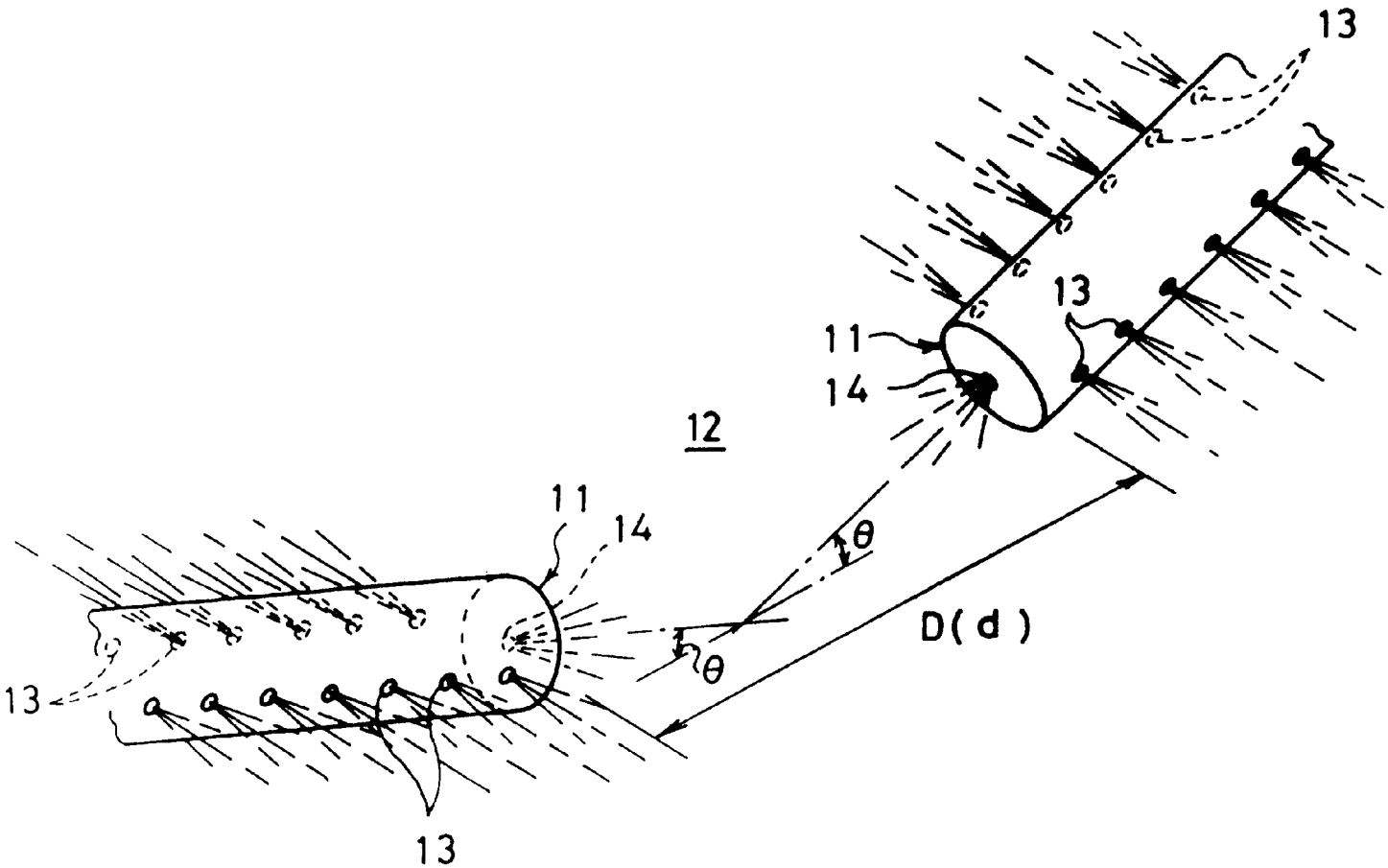
FIG. 4 is a diagram showing dispersive air pipes for combustion in the same fluidized bed waste incinerator.

As shown in FIG. 4, a plurality of main dispersive air holes 13 through which dispersive air is emitted in a lateral direction are provided in each dispersive air pipe 11 for combustion in the sides of the shaft thereof. Furthermore, an end dispersive air hole 14, through which dispersive air is emitted into the incombustible material discharge space 12 in the axial direction of the dispersive air pipe 11 for combustion, is formed at the end of each dispersive air pipe 11 for combustion. By means of the dispersive air emitted from these end dispersive air holes 14, the fluid medium is transferred towards the incombustible material discharge space 12, and incombustible material accumulated on the dispersive air pipes for combustion 11 can be caused to flow towards the incombustible material discharge space 12.

Furthermore, these dispersive air pipes for combustion 11 are set to an angle of inclination θ in the range of 3–30°. If this angle of inclination θ is less than 3°, then it is difficult to eliminate accumulation of incombustible material, since the fluid force due the weight of the incombustible material is small. Moreover, if this angle of inclination θ is over 30°, then the fluid medium S will not be dispersed and fluidized effectively by the dispersive air emitted from the main dispersive air holes 13, and therefore it will have a detrimental effect on the dispersion and fluidization of the fluid medium S.

The incombustible material discharge space 12 comprises normal incombustible material discharge spaces 12*a* having a narrow width d located at the front and rear portions thereof, and a large incombustible material discharge space 12*b* having a broad width D located in the center portion thereof, corresponding to a position above the ash discharge outlet 6. The width d of the normal incombustible material discharge spaces 12*a* is set to be approximately 100–150 mm or more, for example. The width D of the large incombustible material discharge space 12*b* is set to be approximately 500–800 mm, for example, such that large items of incombustible material can be discharged without difficulty. In this large incombustible material discharge space 12*b*, dispersion and fluidization of the fluid medium S is not promoted since no dispersive air is supplied.

In the composition described above, waste introduced into the waste inlet 4 is mixed with the fluid medium S in the drying and pyrolyzing zone 2*a*, fluidized by churning and heating, and then dried and pyrolyzed. Thereupon, the waste is incinerated by combustion in the combustion zone 2*b*. The incinerated ash falls down between the parallel dispersive air pipes for combustion 11 and through the space under the dispersive air pipes for combustion 11 and is discharged by means of the discharging device 5 at the ash discharge outlet 6.

In this case, since the dispersive air pipes for combustion 11 are inclined at an angle, even if the waste contains large or linear items of incombustible material, such items of incombustible material are guided towards the lower ends of the dispersive air pipes for combustion 11, without accumulating thereon. These large or linear items of incombustible material then pass through the incombustible material discharge space 12 and fall downwards, without accumulating or becoming caught, and they are discharged from the ash discharge outlet 6. In this case, the downward movement of incombustible material is further promoted by the dispersive air emitted from the end dispersive air holes 14 into the incombustible material discharge space 12.

According to the first embodiment described above, since dispersive air pipes 11 for combustion project respectively from the side walls 1*b*, 1*c* in an oblique downward direction, and since an incombustible material discharge space 12 is formed at the ends of these dispersive air pipes for combustion 11, large or linear items of incombustible material present in the waste, or large lumps of clinker formed inside the furnace, are guided downwards on the dispersive air pipes for combustion 11 and can be discharged through the incombustible material discharge space 12.

Furthermore, since end dispersive air holes 14 are formed in the ends of the dispersive air pipes for combustion 11, the downward movement of incombustible material is promoted by the dispersive air emitted from these end dispersive air holes 14 into the incombustible material discharge space 12, and incombustible material can be discharged smoothly.

Figure 5:
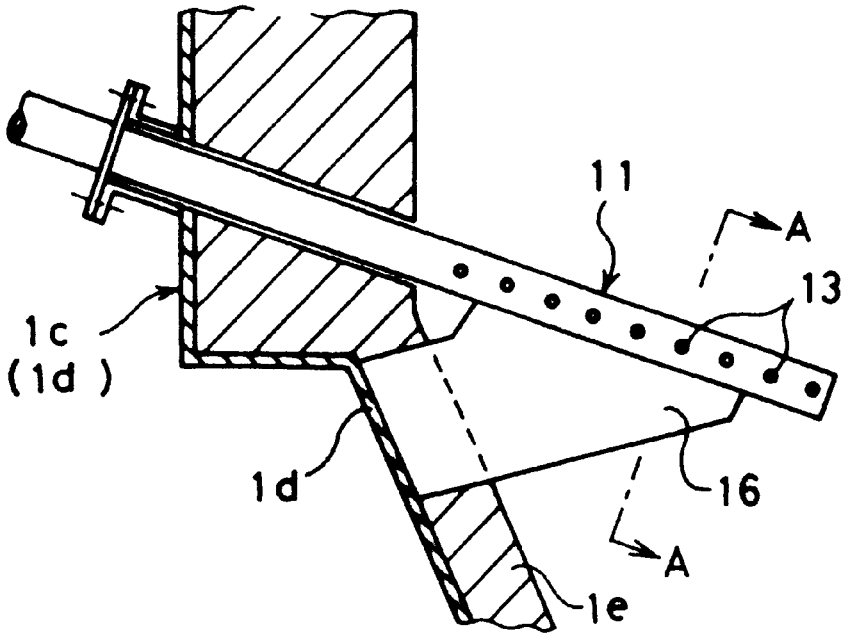
FIG. 5 is a side view showing a further installation structure for the same dispersive air pipes for combustion.

Moreover, in the mode of implementation described above, if the dispersive air pipes for combustion 11 have insufficient strength with respect to the weight of the fluid medium S and the waste, then as shown in FIG. 5 and FIG.

6, it is possible to provide sufficient support for the load imposed on the dispersive air pipes for combustion 11 by the fluid medium S, by inserting support plates 16 which pass from the skin plate 1*d* of the side walls 1*b*, 1*c* through fire retardant material 1*e*, and by joining the upper edges of these support plates 16 securely to the lower side of the dispersive air pipes for combustion 11.

Figure 7:
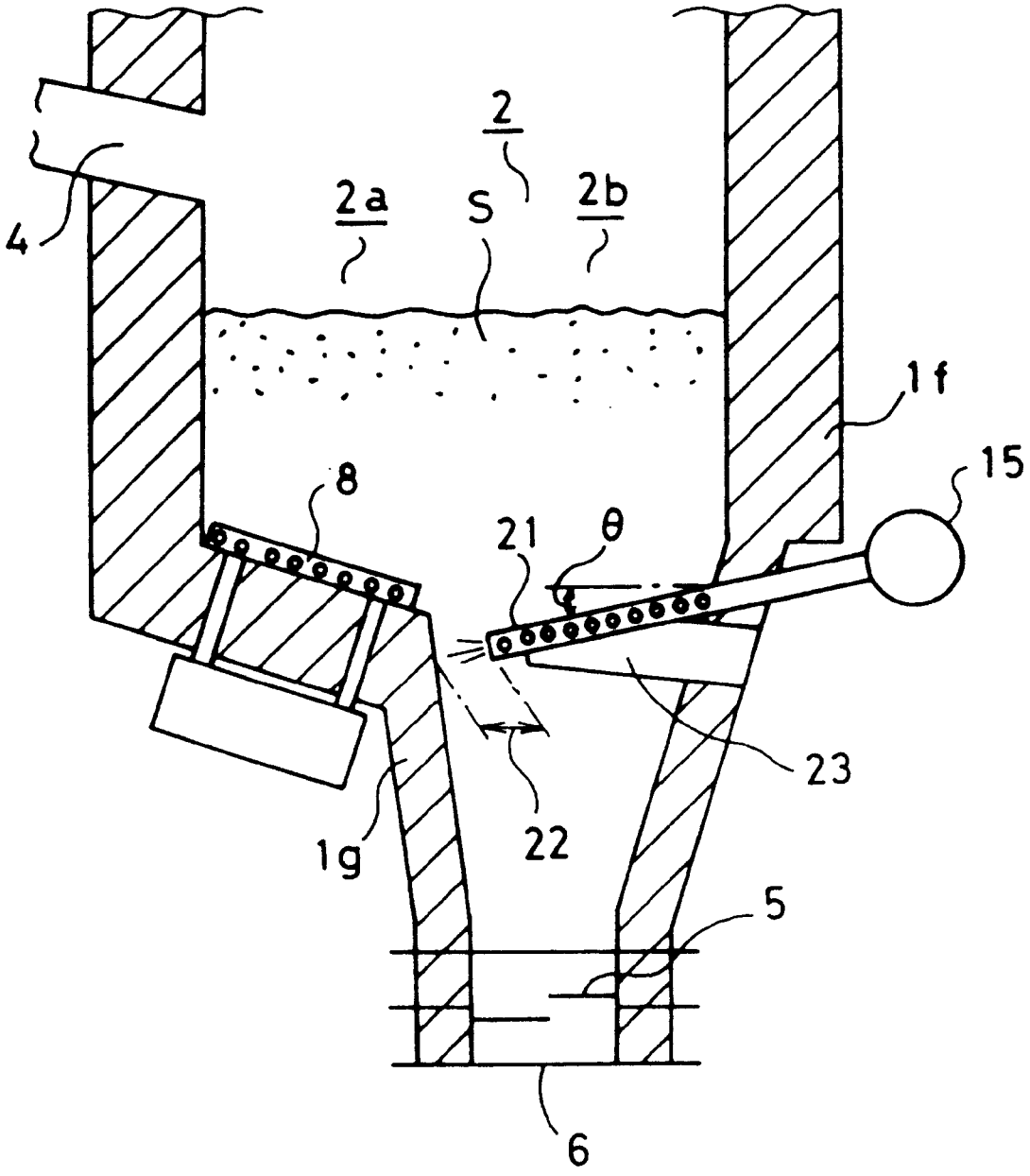
FIG. 7 is a side section showing a second embodiment of a fluidized bed waste incinerator according to the present invention.
Figure 8:
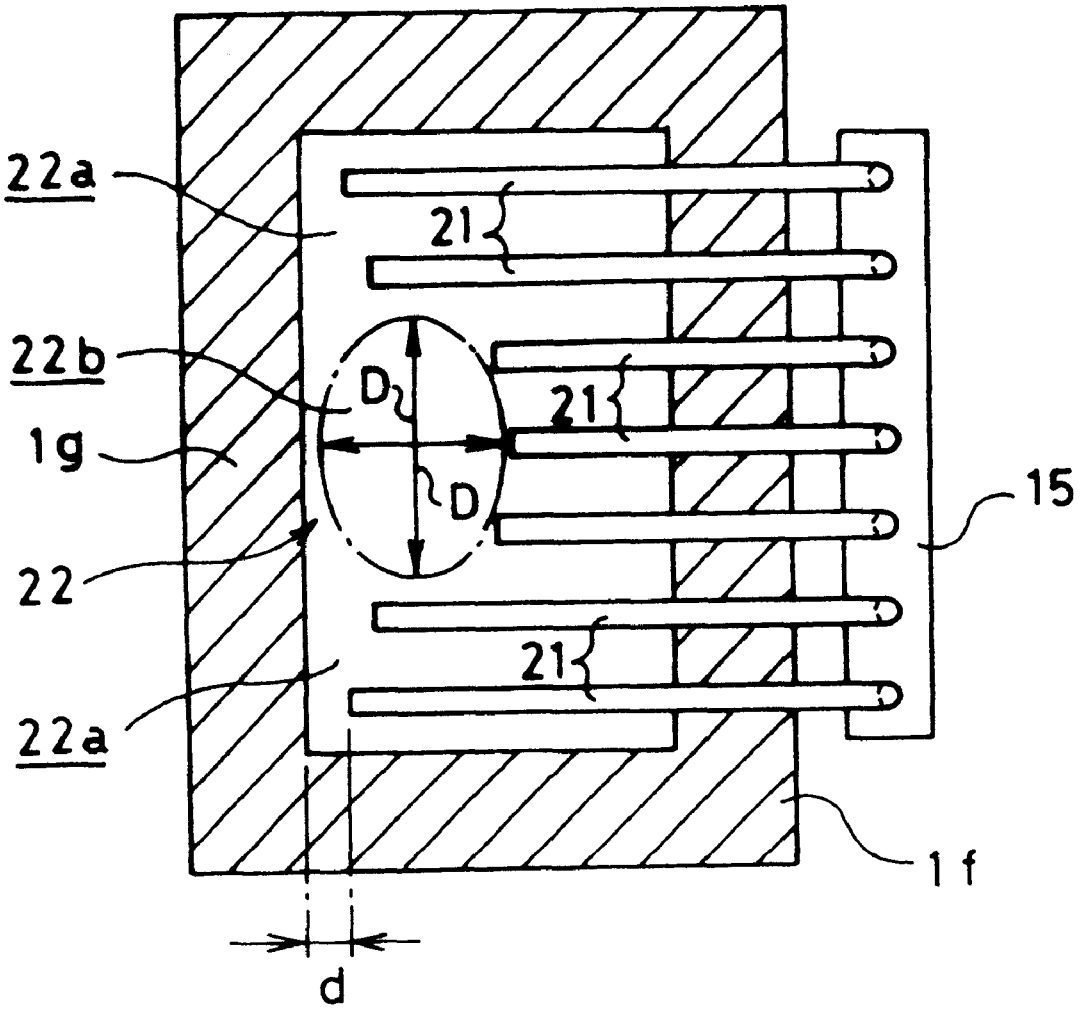
FIG. 8 is a planar section of the same fluidized bed waste incinerator.

Next, a second embodiment is described on the basis of FIG. 7 and FIG. 8.

In the second embodiment, dispersive air pipes for combustion 21 of the same structure as those in the first embodiment project at an angle of inclination θ from the rear side wall 1*f* only, and therefore an incombustible material discharge space 22 is formed between the ends of these dispersive air pipes for combustion 21 and the lower portion of the front side wall 1*g*.

Figure 6:
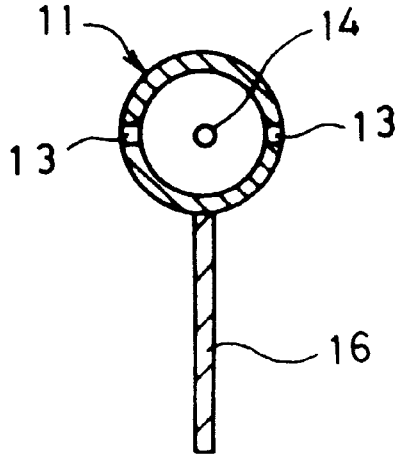
FIG. 6 is a section taken along A—A in FIG. 5.

This incombustible material discharge space 22 comprises a large incombustible material discharge space 22*b* located in the center portion thereof, and normal incombustible material discharge spaces 22*a* located in side portions thereof. Furthermore, support plates 23 of the same structure as that shown in FIG. 5 and FIG. 6 are attached to each of the dispersive air pipes for combustion 21. According to this composition, large or linear items of incombustible material, or large lumps of clinker, can be discharged smoothly in a similar manner to the first mode of implementation. It is also possible to reduce material usage and assembly processes, thereby lowering manufacturing costs.

Figure 9:
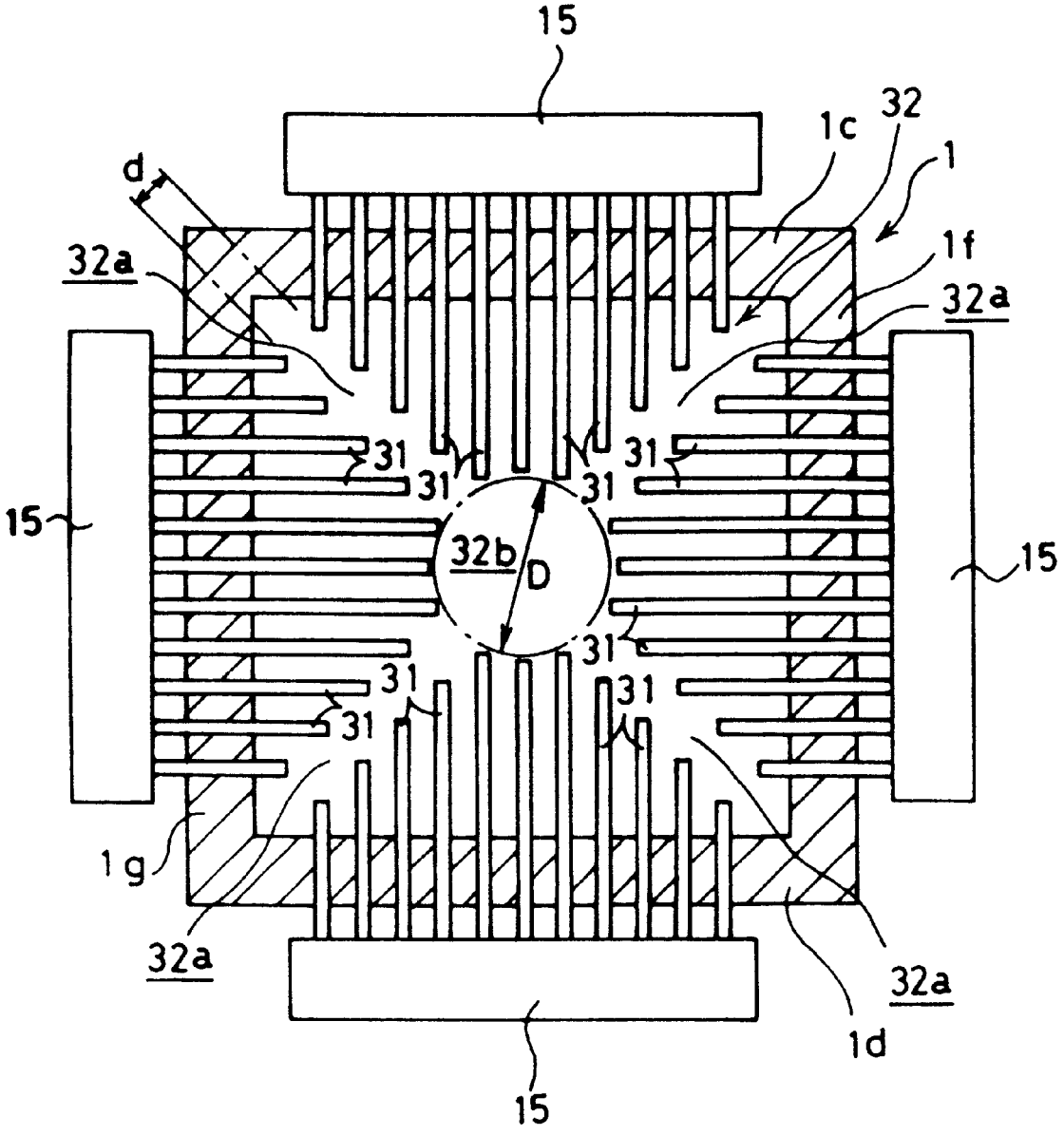
FIG. 9 is a planar section showing a third embodiment of a fluidized bed waste incinerator according to the present invention.
Figure 10:
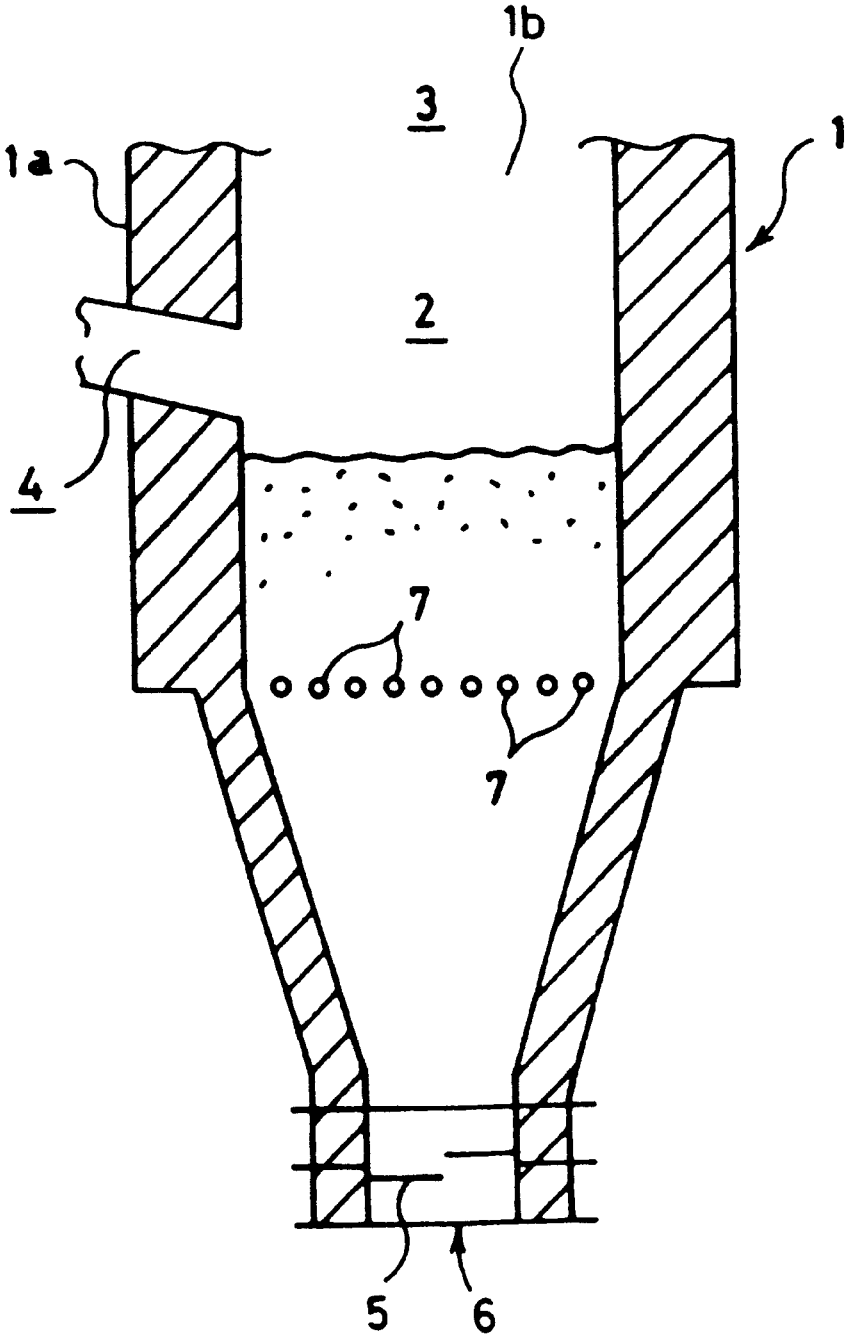
FIG.10 PRIOR ART
FIG. 10 is a side section showing a conventional fluidized bed waste incinerator.

A third embodiment is now described on the basis of FIG. 9.

In this fluidized bed incinerator, dispersive air pipes for combustion 31 of the same structure as those in the first embodiment project respectively from the side walls 1*b*, 1*c*, and from the rear side wall 1*f* and the lower front side wall 1*g*, an incombustible material discharge space 32 being formed between the ends of these dispersive air pipes for combustion 31.

This incombustible material discharge space 32 comprises a large incombustible material discharge space 32*b* located in the center portion thereof, and normal incombustible material discharge spaces 32*a* formed along the diagonals thereof.

According to the composition described above, large or linear items of incombustible material, and large lumps of clinker, can be discharged smoothly similarly to the first embodiment.

What is claimed is:

1. A fluidized bed incinerator construction comprising:

an ash discharge outlet (6) formed in a base portion of a furnace main unit (1);

a plurality of dispersive air pipes for combustion (11, 31) which project into the furnace main unit (1) from each of laterally spaced apart side walls (1*b*, 1*c*) (1*c*, 1*d*, 1*f*, 1*g*) of the furnace main unit (1), the dispersive air pipes for combustion (11, 31) being cantilevered to each of said side walls and extending inwardly into the furnace main unit (1) in an oblique downward direction and terminating in inner ends at a lower portion of a combustion zone (2*b*), the dispersive air pipes for combustion (11, 31) projecting from each of said side walls being in spaced parallel relation to one another so that ash can be discharged therebetween;

an incombustible material discharge space (12, 32) formed between the ends of the dispersive air pipes for combustion (11, 31) projecting from the respective laterally spaced apart side walls and above the ash discharge outlet (6);

the dispersive air pipes for combustion (11, 31) containing a large number of dispersive air holes (13) through which dispersive air is emitted, formed in side walls of the pipes (11, 31), and a dispersive air hole 14, through which dispersive air is emitted into the incombustible material discharge space (12, 32), formed at the inner ends of the pipes (11, 31);

wherein the ash discharge between the parallel dispersive air pipes for combustion (11, 31) is discharged through a space under the dispersive air pipes for combustion (11, 31) toward the ash discharge outlet (6), and incombustible material on the dispersive air pipes for combustion (11, 31) is discharged through the incombustible material discharge space (12, 32) toward the ash discharge outlet (6).

2. A fluidized bed incinerator construction according to claim 1, wherein the dispersive air pipes for combustion (11, 21, 31) have an angle of inclination (θ) from a plane across the side walls of the furnace main unit at points where said dispersive air pipes are cantilevered to said side walls in the range of 3°–30°.

3. A fluidized bed incinerator construction comprising:

an ash discharge outlet (6) formed in a base portion of a furnace main unit (1);

a plurality of dispersive air pipes for combustion (11, 31), containing a large number of dispersive air holes (13, 14) formed therein, which are cantilevered to laterally spaced apart opposing side walls (1*b*, 1*c*) (1*c*, 1*d*, 1*f*, 1*g*) of the furnace main unit (1) and extend inwardly into the furnace main unit (1) in an oblique downward direction at a lower portion of a combustion zone (2*b*) of the furnace main unit (1) and terminate in inner ends; and an incombustible material discharge space (12, 22, 32) formed between the inner ends of the dispersive air pipes for combustion;

wherein the incombustible material discharge space (12, 22, 32) comprises normal incombustible material discharge spaces (12*a*, 22*a*, 32*a*) having a narrow width, and a large incombustible material discharge space (12*b*, 22*b*, 32*b*) having a broad width.

4. A fluidized bed incinerator construction comprising:

an ash discharge outlet (6) formed in a base portion of a furnace main unit (1);

a plurality of dispersive air pipes for combustion (21), containing a large number of dispersive air holes (13, 14) formed therein, which are cantilevered to a side wall (1*f*) of the furnace main unit (1) and extend inwardly into the furnace main unit (1) in an oblique downward direction at a lower portion of a combustion zone (2*b*) of the furnace main unit (1); and an incombustible material discharge space (12, 22, 32) formed between the inner ends of the dispersive air pipes for combustion (21) and a side wall (1*g*) of the furnace main unit (1);

wherein the incombustible material discharge space (12, 22, 32) comprises normal incombustible material discharge spaces (12*a*, 22*a*, 32*a*) having a narrow width, and a large incombustible material discharge space (12*b*, 22*b*, 32*b*) having a broad width.

* * * * *